US009427114B2

(12) United States Patent
Tong

(10) Patent No.: US 9,427,114 B2
(45) Date of Patent: Aug. 30, 2016

(54) MAGNETIC DRAIN STOPPER ASSEMBLY AND METHOD

(76) Inventor: Henry Tong, Northville, MI (US)

( * ) Notice: Subject to any disclaimer, the term of this patent is extended or adjusted under 35 U.S.C. 154(b) by 258 days.

(21) Appl. No.: 13/978,448

(22) PCT Filed: Jun. 13, 2012

(86) PCT No.: PCT/US2012/042318

§ 371 (c)(1),
(2), (4) Date: Aug. 7, 2013

(87) PCT Pub. No.: WO2012/174163

PCT Pub. Date: Dec. 20, 2012

(65) Prior Publication Data

US 2013/0312177 A1 Nov. 28, 2013

Related U.S. Application Data

(60) Provisional application No. 61/497,571, filed on Jun. 16, 2011.

(51) Int. Cl.
*A47K 1/14* (2006.01)
*E03C 1/23* (2006.01)

(52) U.S. Cl.
CPC ..... *A47K 1/14* (2013.01); *E03C 1/2302* (2013.01); *E03C 2001/2311* (2013.01)

(58) Field of Classification Search
CPC . E03C 2001/2311; E03C 1/23; E03C 1/2302
See application file for complete search history.

(56) References Cited

U.S. PATENT DOCUMENTS 2,077,516 A 4/1937 Dart
3,010,118 A 11/1961 Isherwood
3,368,788 A 2/1968 Padula
3,652,054 A 3/1972 Layton
4,945,579 A 8/1990 Husting
5,208,921 A 5/1993 Nicoll
5,230,365 A 7/1993 Woltz et al.
5,333,327 A 8/1994 Redding et al.
5,640,724 A 6/1997 Holmes
6,282,730 B1 * 9/2001 Duncan ..... A47K 1/14 251/65
6,341,391 B1 1/2002 Cheng
6,484,330 B2 11/2002 Gray et al.
6,725,472 B2 4/2004 Gray et al.
7,086,550 B2 8/2006 Yang et al.
7,530,123 B2 5/2009 Cao et al.
2009/0255041 A1 10/2009 Duncan
2009/0255054 A1 10/2009 Duncan

FOREIGN PATENT DOCUMENTS

JP 7317118 A 12/1995
JP 2001020340 A 1/2001

* cited by examiner

*Primary Examiner* — Janie Loeppke
(74) *Attorney, Agent, or Firm* — Endurance Law Group, PLC

(57) ABSTRACT

A magnetic drain stopper for use in a basin drain. A stopper is disposed for reciprocation in the drain pipe and includes a stopper magnet. A curvilinear actuator outside the drain pipe supports one or more driver magnets for movement in a non-linear path toward and away from the stopper magnet. When moved toward the stopper magnet, the driver magnets induce the stopper to lift away from a sealed condition so that water can exit the basin. The curvilinear actuator may include a generally cylindrical base captured in a sleeve-like hinge bracket. A control rod is coupled to a push rod that receives manual input from a user. A pair of flanking legs may be attached to the ends of the base, with each leg carrying a driver magnet half. The curvilinear actuator may include an optional draw-down magnet to hold the stopper in its sealed condition.

20 Claims, 9 Drawing Sheets

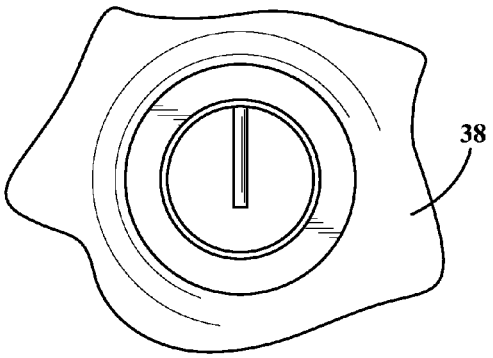
FIG. 2
PRIOR ART
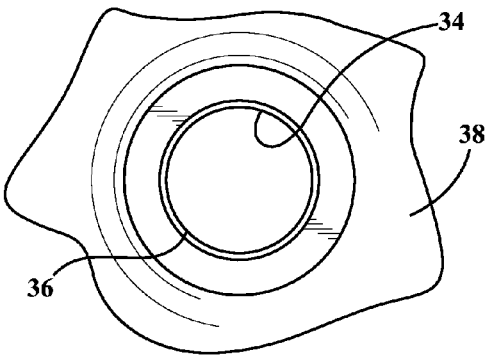
FIG. 3
FIG. 4
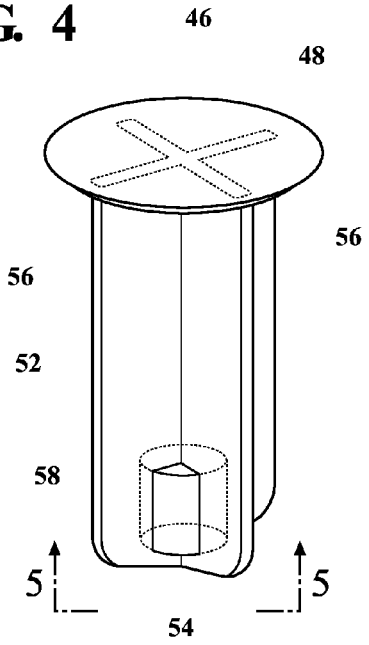
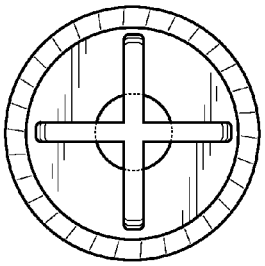
FIG. 5

MAGNETIC DRAIN STOPPER ASSEMBLY AND METHOD

CROSS REFERENCE TO RELATED APPLICATIONS

This application claims priority to Provisional Patent Application No. 61/497,571 filed Jun. 16, 2011, the entire disclosure of which is hereby incorporated by reference and relied upon.

BACKGROUND OF THE INVENTION

1. Field of the Invention

A drain stopper basins, and more specifically a magnetically actuated drain stopper.

2. Related Art

Basins, bathtubs, sinks and other varieties of receptacles (hereinafter collectively "basins") are used in various applications to hold water or other liquids. Basins often include a drain passage through which liquid retained in the basin can be purged. Typically, the opening to the drain passage can be selectively closed by positioning a stopper in or over the opening. In many common configurations, the stopper is manually actuated through a lever-operated linkage to lift the head of the stopper away from the opening so that liquid (e.g., water) can run by gravity into the drain passage. Examples of prior art drain stopper assemblies manually actuated through a lever-operated linkage may be found in U.S. Pat. No. 6,341,391 to Cheng, issued Jan. 29, 2002 and U.S. Pat. No. 6,484,330 to Gray et al., issued Nov. 26, 2002. FIG. 1 illustrates a prior art basin and drain stopper assembly of the type actuated manually through a lever-operated linkage.

While prior art drain stopper assemblies like that shown in FIG. 1 are functional, all share the common trait of a control rod end positioned inside the drain passage. FIG. 2 is a view looking down the drain passage from above a basin, and showing the typical control rod end disposed to engage the stopper (not shown). This protruding end of the control rod is in the direct flow of liquid as it drains from the basin, thus making the rod end prone to catch and retain debris which, over time, can build up to eventually clog the drain. Moreover, the protruding control rod end impedes easy access to the P-trap in the drain passage below where clog tend to reside. Thus, an attempt to dislodge a clog in the P-trap with a snake or hook through the drain passage opening will be met with opposition by the control rod end. Still further, the control rod penetrates the drain pipe usually through a spherical compression joint, creating a potential leak path.

To address some of the shortcomings of prior art drain stopper assemblies like that shown in FIG. 1, the prior art has also taught to fashion a magnetically actuated drain stopper assembly. Examples of these types of devices may be found in U.S. Pat. No. 5,208,921 to Nicoll, issued May 11, 1993 and U.S. Pat. No. 5,640,724 to Holmes, issued Jun. 24, 1997. Such devices utilize a specially configured stopper having a magnet attached to its lower guide section. This stopper magnet interacts with a driver magnet supported outside the drain pipe. Magnetic flux interactions between the stopper and driver magnets cause the stopper to lift when the driver magnet is pulled up and to fall when the driver magnet is lowered. One particular advantage of a magnetically actuated drain stopper assembly is evident from FIG. 3 which is a top view of a drain passage as in FIG. 2 but notable by the absence of any protruding control rod end.

The drain passage of a magnetically actuated drain stopper assembly is clear of any internal obstruction, thereby facilitating the drainage of liquids from the basin without exacerbating clogs, enabling unimpeded access to the P-trap with a snake or hook through the drain passage opening, and the absence of additional potential leak paths from a penetrating control rod.

Most if not all prior art style magnetically actuated drain stopper assemblies are configured so that the external driver magnet(s) is mounted on the drain pipe to slide linearly up and down. These are designed to maintain a relatively constant spacing between the driver and stopper magnets. In other words, there is a one-to-one (1:1) corresponding movement of the stopper in relation to the displacement of the driver magnet. This one-to-one relationship has many disadvantages. If the operator pulls upwardly too rapidly on the driver magnet, they can overcome the stopper magnet so that it does not lift. Stronger magnets than otherwise necessary may be used to help prevent this condition. Furthermore, a sliding motion is difficult to maintain in proper working order over a long period of time. The underside of a basin is typically clamp and neglected for long periods of time so that dirt build-up can go undetected. Mechanical systems that operate in this environment must be robust and not prone to malfunction in dirty conditions.

Thus, there is a need in the art for an improved magnetic stopper assembly for a basin drain that provides easier and greater access to the drain, that functions mare reliably, and that is not prone to malfunction.

SUMMARY OF THE INVENTION

The present invention comprises a drain stopper assembly for a drain pipe defining an internal drain passage, the drain passage having an upper entrance leading into the drain passage. A stopper is disposed for movement with respect to the upper entrance away from and toward a sealed condition to prevent the passage of liquid into the drain passage. The stopper includes a stopper magnet that produces an electromagnetic field. A driver magnet is situated external to the drain pipe. The driver magnet produces at least one electromagnetic field that generates a repellant electromagnetic field with respect to the stopper magnet. A curvilinear actuator is disposed external to the drain pipe and operatively supports the driver magnet for movement along a curved path toward the stopper magnet so that the electromagnetic fields interact with one another to induce movement of the stopper away from the sealed condition.

The invention also contemplates a method of moving a drain stopper between sealed and unsealed conditions. According to the method, a drain pipe has an upper entrance. A stopper is positioned in the upper entrance, and includes a stopper magnet that produces an electromagnetic field. A driver magnet is situated external to the drain pipe. The driver magnet produces at least one electromagnetic field. The driver magnet is moved along a curved path toward the stopper magnet to induce movement of the stopper away from the upper entrance.

An advantage of the present invention is that the curvilinear motion of the driver magnet functions more reliably than prior art designs and is not prone to malfunction even in adverse operating conditions that experience long periods of neglect. Manual control of the driver magnet is such that an operator is less likely to overtake the stopper magnet when raising the stopper. A further advantage is that the curvilinear motion of the driver magnet easily and reliably works with an existing faucet lift rod without having to use any special lubricants.

BRIEF DESCRIPTION OF THE DRAWINGS

These and other features and advantages of the present invention will become more readily appreciated when considered in connection with the following detailed description and appended drawings, wherein:

FIG. 2 is a top view of a prior art drain pipe leading from a sink basin, illustrating the obstruction created in the drain pipe by the drain stopper control linkage;

FIG. 3 is a view of a drain pipe leading from a sink basin as in FIG. 2, but showing the unobstructed passage enabled by the present invention;

FIG. 4 is a perspective view of a magnetically actuated stopper according to one embodiment of the invention;

FIG. 5 is a bottom view of the stopper as taken generally along lines 5-5 in FIG. 4;

DETAILED DESCRIPTION OF THE PREFERRED EMBODIMENT

Figure 1:
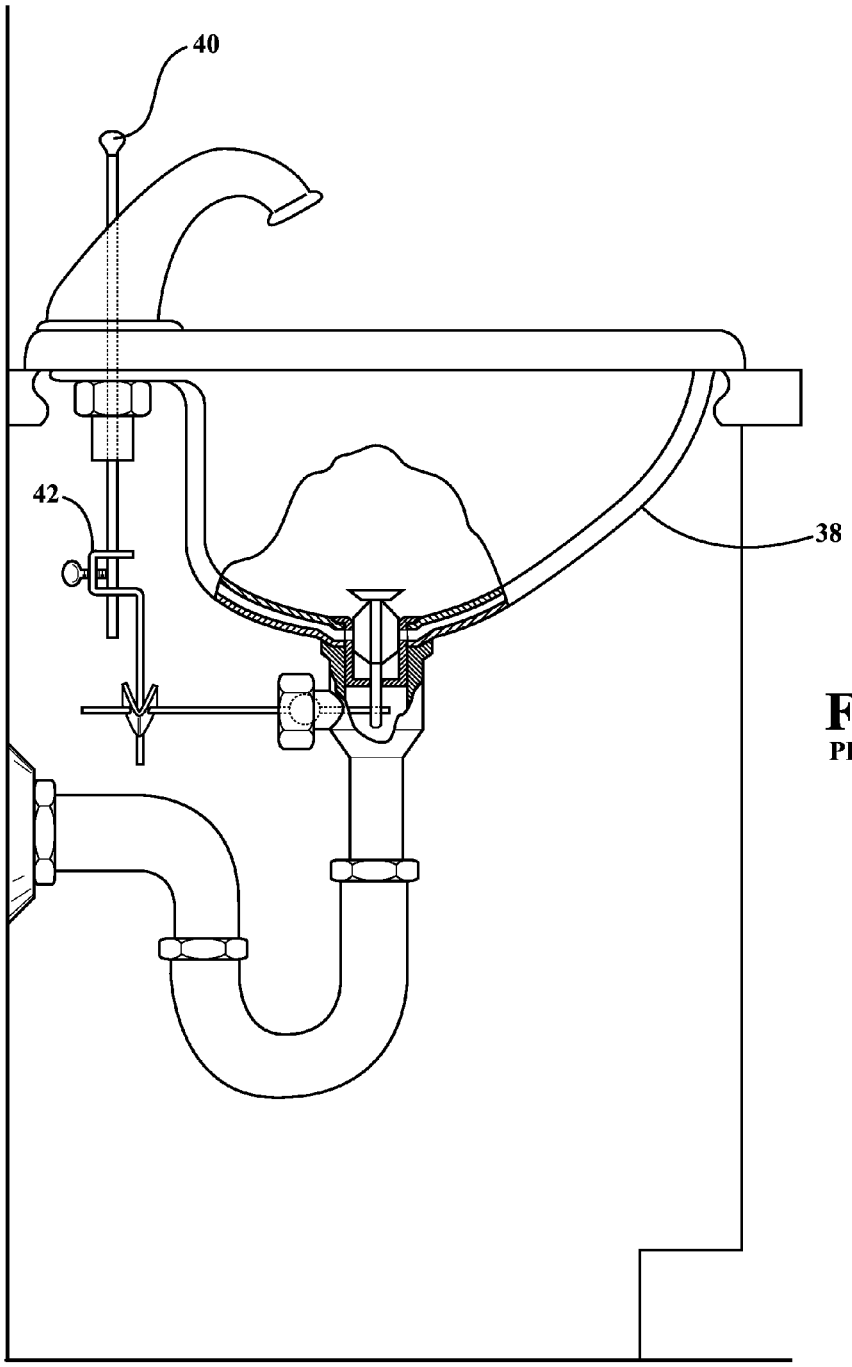
FIG. 1 PRIOR ART
FIG. 1 is an exemplary prior all lavatory sink and drain assembly, with the sink basin portion shown in partial cross-section to illustrate the drain stopper controlled by a mechanically linked push rod.

Referring to the FIGS. 3-12, wherein like numerals indicate like or corresponding parts throughout the several views, a drain stopper assembly according to a first embodiment of the invention is generally shown at 30. The drain stopper assembly 30 is adapted for use in conjunction with a drain pipe 32 defining an internal drain passage 34. An upper entrance 36 leads into the drain passage 34. As perhaps best shown in FIG. 6, the drain pipe 32 is adapted to be mounted within an opening in a basin 38 so that its upper entrance 36 can receive water or other liquids from the basin 38.

A push rod 40 (FIG. 1) is disposed for manipulation in a generally up and down path by a user. The lower end of the push rod 40 may be joined to an adjustable interface member 42, which in turn connects with the distal end of a control rod 44 of the stopper assembly 30.

The assembly 30 includes a stopper, generally indicated at 46. The stopper 46 is disposed for movement with respect to the upper entrance 36 toward and away from a sealed condition. In a raised or lifted condition (FIGS. 6 and 7), water is free to escape from the basin 38. However in the sealed condition (FIG. 10) water is trapped in the basin 38. The stopper 30 includes a head 48, which may be circular in shape and made of clad or unclad plastic or other suitable material. The head 48 may be fashioned with or without an O-ring seal 50 to help establish a water-tight seal with respect to the basin 38 and/or the upper entrance 36 of the drain passage 34. A guide section 52 depends from the head 48 to help control or stabilize movement of the stopper 46 between its raised and lowered (i.e., sealed) conditions. The guide section 52 is preferably made from plastic, but other materials (preferably non-ferromagnetic) can be used. The guide section 52 has a lower distal end 54 spaced apart from the head 48, and may take many alternative forms. In the illustrated examples, the guide section 52 comprises a plurality of longitudinally extending fins 56.

The stopper 46 is fitted with a stopper magnet 58 that produces an electromagnetic field of sufficient strength. Preferably, the stopper magnet 58 is of the permanent magnet type, and more specifically still of the rare-earth type which are known to produce significantly stronger magnetic fields than other types such as ferrite or alnico magnets. The magnetic field typically produced by rare-earth magnets can be in excess of 1.4 teslas. However, it will be appreciated that stopper magnet 58 could be fashioned from any type of permanent magnets (rare earth and weaker magnets) as well as from electromagnets. In the illustrated embodiment, the stopper magnet 58 disposed more or less centrally in the guide section 52 adjacent it distal end 54. Attachment can be accomplished by any suitable technique, including over-molding, bonding, snap-fit, and the like. The stopper magnet 58 can be a single, unitary, monolithic element or a congregation of discrete magnet parts held in fairly close proximity to achieve functional unity.

The assembly 30 also includes a driver magnet, generally indicated at 60, situated external to the drain pipe 32. The driver magnet 60 produces at least one electromagnetic field that generates a repellant electromagnetic field with respect to the stopper magnet 58 so as to induce movement of the stopper 46 away from its sealed condition. That is, the driver magnet 60 is used to push or lift the stopper 46 away from the upper entrance 36 of the drain pipe 32 so that water can exit the basin 38. The driver magnet 60 is also preferably of the permanent magnet type, and more specifically still of the rare-earth type which includes both neodymium magnets and samarium-cobalt magnets. However, other magnet types can be used, including non-rare earth permanent magnets and electro-magnets if desired.

Figure 6:
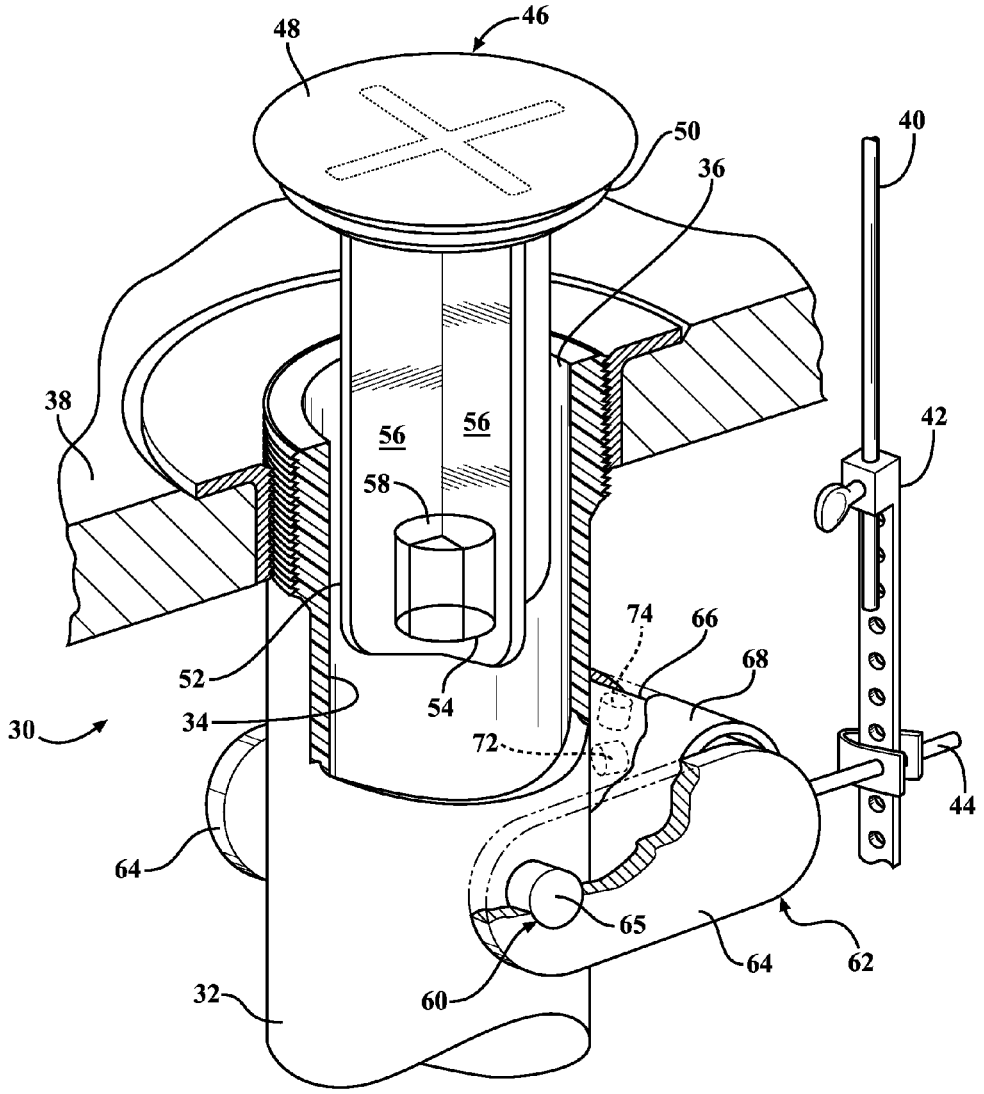
FIG. 6 is a perspective view of a magnetically actuated stopper and drain assembly according to a first embodiment of the invention with the stopper depicted in a lifted or raised condition to allow the drainage of fluids into the drain pipe.
Figure 8:
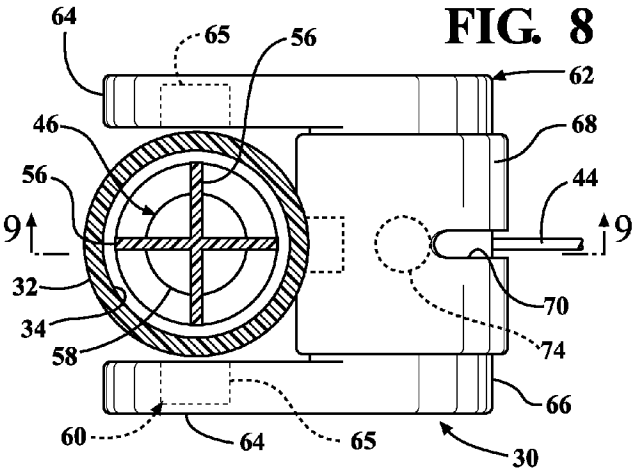
FIG. 8 is cross-sectional view taken generally along lines 8-8 in FIG. 7.
Figure 9:
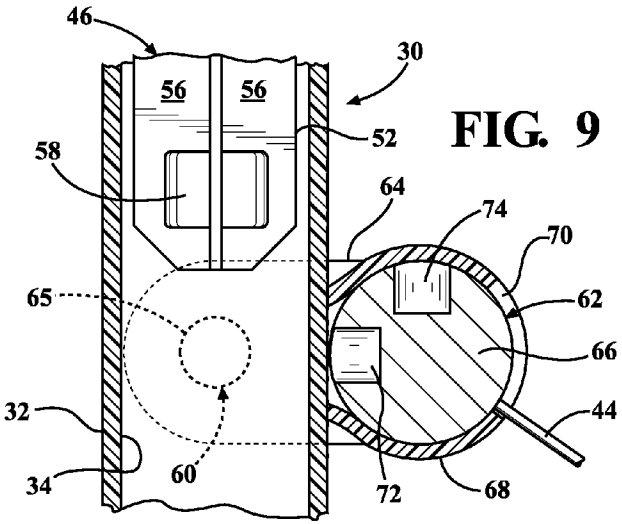
FIG. 9 is cross-sectional view taken generally along lines 9-9 in FIG. 8.
Figure 7:
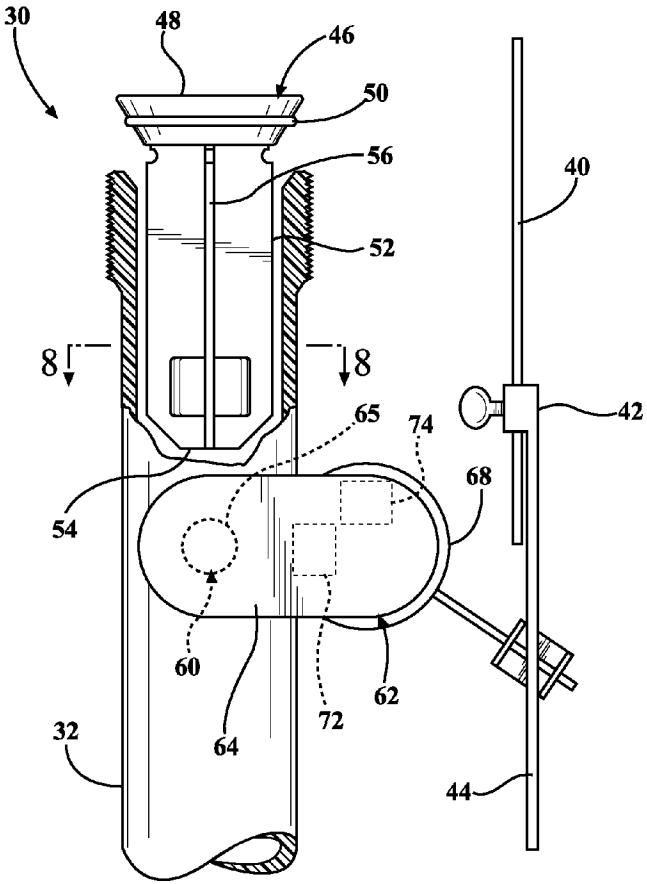
FIG. 7 is a side view of the first embodiment of the invention showing the stopper in a lifted or raised condition.
Figure 12:
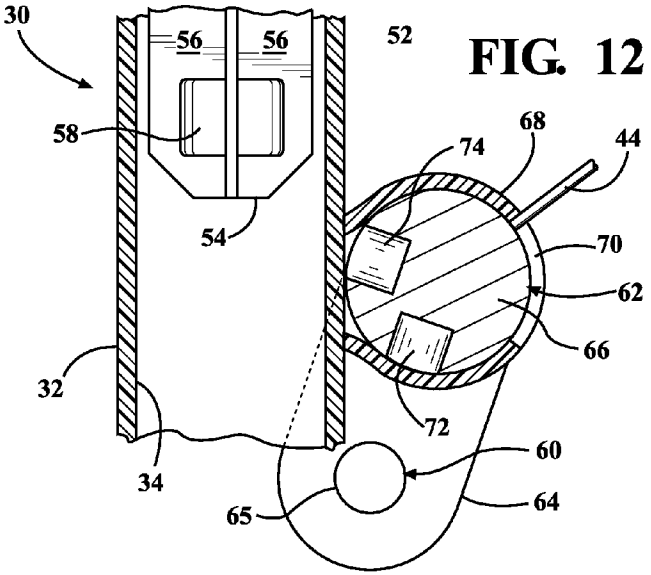
FIG. 12 is cross-sectional view taken generally along lines 12-12 in FIG. 11.
Figure 11:
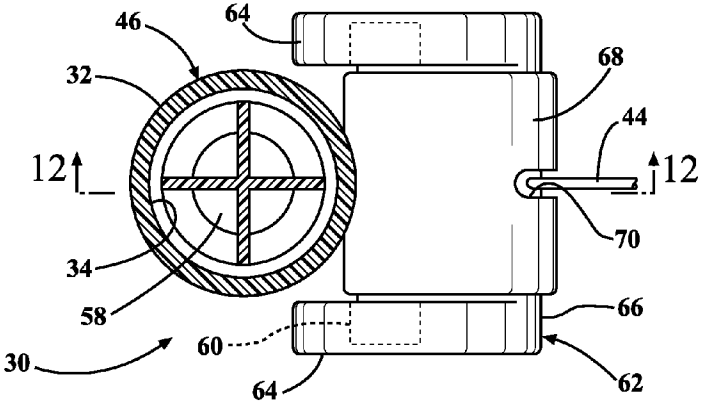
FIG. 11 is cross-sectional view taken generally along lines 11-11 in FIG. 10.
Figure 10:
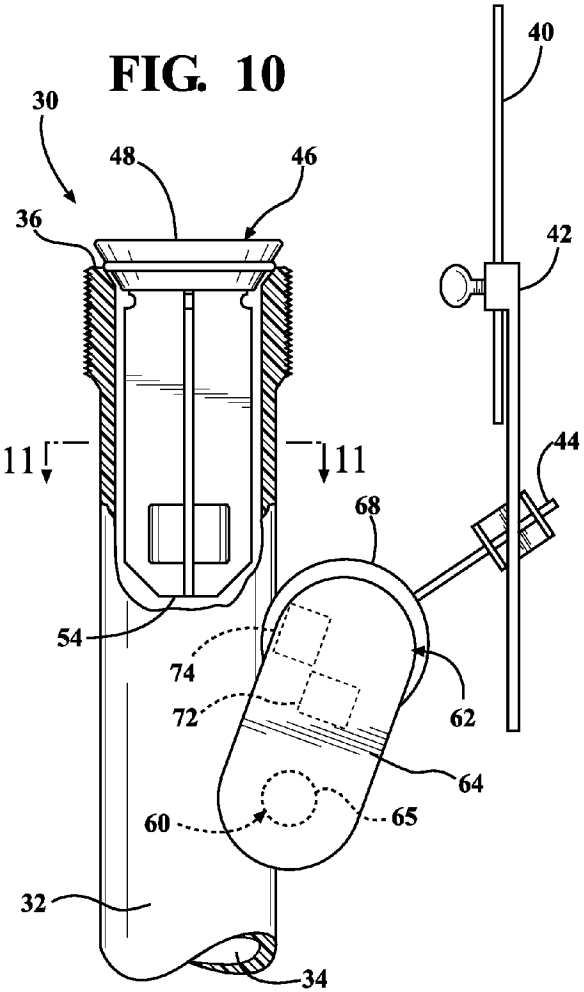
FIG. 10 is a side view as in FIG. 6 but showing the stopper in a lowered condition.

A curvilinear actuator, generally indicated at 62, operatively supports the driver magnet 60 for movement along a curved path toward the stopper magnet 58 so that their respective electromagnetic fields interact in a repelling manner to induce movement of the stopper 46 away from its sealed condition. In other words, as the curvilinear actuator 62 moves the drive magnet 60 closer to the stopper magnet 58, the interacting magnetic forces cause the stopper 46 to elevate thus opening an egress for liquids to flow into the drain pipe 32. As shown in FIGS. 6-12, the curvilinear actuator 62 is disposed external to the drain pipe 32. Preferably, the curvilinear actuator 62 is formed in a generally U-shaped configuration (FIG. 8) defined by spaced apart legs 64 connected though a common base 66. The base 66 may have a cylindrical configuration so that its outer surface can function as a hinge. The legs 64 are moveable to a position on opposite sides of the drain pipe 32 as shown in FIGS. 6-8, in which the stopper 46 is induced to raise away from the upper entrance 36.

The driver magnet 60 may take any of various forms suitable to motivate movement of the stopper 46 away from its sealed condition. In the first embodiment of the invention illustrated in FIGS. 6-12, the driver magnet 60 is comprised of a pair of driver magnet halves 65 spaced apart from one another and disposed on opposite exterior sides of the drain pipe 32. One driver magnet half 65 is disposed on one of the legs 64 and the other driver magnet half 65 is disposed on the other leg 64. In alternative examples, the driver magnet 60 may comprise only one strategically located magnet, or several strategically located magnets.

The assembly 30 includes a hinge bracket 68 adapted for attachment to the drain pipe 32. Although FIGS. 6-12 suggest a fixed attachment between the hinge bracket 68 and exterior surface of the drain pipe 32, a vertically adjustable connection may be preferred in some cases to allow line-tuning of the placement of the driver magnets 60 relative to the stopper magnet 58. The hinge bracket 68 is shown here as a short cylindrical section sized to receive the cylindrical base 66 of the curvilinear actuator 62. As such, the curvilinear actuator 62 is able to pivot inside the hinge bracket 68 while the legs 64 scribe an arcuate path. And more specifically, the hinge feature is disposed in a generally horizontal plane so that the curvilinear actuator swings in a generally vertical arc in direct response to up and down movement of the push rod 40. The driver magnet halves 65 thus trace a generally circular and vertical arc as they are moved by the operator. Those of skill in the art will appreciate alternative constructions for supporting the driver magnets 60 for movement in a non-linear path. These alternative constructions may or may not include a fixed hinge-like arrangement as shown in FIGS. 6-11. In one alternative example, the hinge bracket may extend like a fin or flange from the drain pipe 32 and support a simple pin or axel to allow the driver magnets 60 to swing in an arc toward and away from the stopper magnet 58. Of course, many alternative constructions are possible.

The control rod 44 extends radially from the base 66 opposite the legs 64. A slot 70 in the hinge bracket 68 accommodates the control rod 44 so that the curvilinear actuator 62 is permitted to pivot back and forth approximately 90 degrees. The slot 70 also traps the control rod 44 to help maintain the orientation of the curvilinear actuator 62 relative to the drain pipe 32. As previously described, the control rod 44 is mechanically linked to the push rod 40 so that a user/operator remotely controls rotation of the curvilinear actuator 62 by pulling up on or pushing down on the push rod 40. When art operator pulls up on the push rod 40, the control rod 44 is lifted causing the curvilinear actuator 62 to rotate to the position shown in FIGS. 10-12. In this condition, the repelling forces of the driver magnet 60 are sufficiently far away from the stopper magnet 58 so that it cannot overcome the weight force of the stopper 46. Gravity thus returns the stopper to its sealed condition. However, when the operator pushes down on the push rod 40, the control rod 44 is rotated downwardly causing the curvilinear actuator 62 to rotate to the position shown in FIGS. 6-9. The driver magnet halves 65 carried in the legs 64 are simultaneously brought into proximity with the stopper magnet 58, with the repelling interaction overcoming the opposing gravitation force and inducing elevation of the stopper 46.

The driver magnet 60 may include one or more supplemental magnets 72 carried directly on the base 66 to induce movement of the stopper 46 away from its sealed condition. The supplemental push-up magnet 72 is preferably of the permanent magnet type, and more specifically still of the rare-earth type which includes both neodymium magnets and samarium-cobalt magnets. However, it will be appreciated that the supplemental magnet 72 could be fashioned from any type of permanent magnets (rare earth and weaker magnets) as well as from electromagnets. The supplemental push-up magnet 72 is shown in combination with the driver magnet halves 65 in FIGS. 6-12, however satisfactory results may be attainable with only the supplemental push-up magnet 72, or with multiple individual magnets carried on the base 66.

If gravitational force is not sufficient to return the stopper 46 to its sealed condition when the one or more driver magnets 60 are swung down, added assistance may be provided by way of one or more draw down magnets 74 positioned with respect to the stopper magnet 58 to induce movement of the stopper toward the sealed condition. The draw down magnet 74 is also preferably of the rare-earth, permanent magnet type. In the first embodiment of FIG. 12, the draw down magnet 74 is shown disposed in the base 66 circumferentially offset from the supplemental push-up magnet 72. Depending on the placement and orientation of the draw down magnet 74 with respect to the stopper magnet 58, the magnetic field flux interaction may operate to either urge the stopper 46 downwardly through magnetic attraction or magnetic repulsion. In other words, if when the curvilinear actuator 62 is rotated down the draw down magnet 74 is located below stopper magnet 58, then a magnetic attraction force is needed to pull the stopper 46 more tightly toward the sealed condition. On the other hand, if when the curvilinear actuator 62 is rotated down the draw down magnet 74 is located above stopper magnet 58, then a magnetic repelling force is needed to push the stopper 46 toward its sealed condition.

The curvilinear actuator 62 is particularly effective in a magnetically levitated stopper 46 configuration. Unlike prior art systems in which the spacing between driver and stopper magnets was generally locked into a 1:1 relationship by the linear sliding mechanism, the present invention takes advantage of a motion multiplier effect in which the driver magnets 60 are moved in a compound trajectory laterally as well as longitudinally so that the magnetic fields of the respective magnets 58, 60 interact in a non-linear relationship vis-à-vis the manual input motion of the push rod 40. This configuration facilitates the use of stronger magnets that can be quickly moved far apart when returning the stopper 46 to it sealed condition. The curvilinear actuator also enables more robust structures that are not as prone to malfunction when operated in damp environment's and neglected for long periods of time. Furthermore, the curvilinear actuator 62 is easily and inexpensively manufactured.

Figure 14:
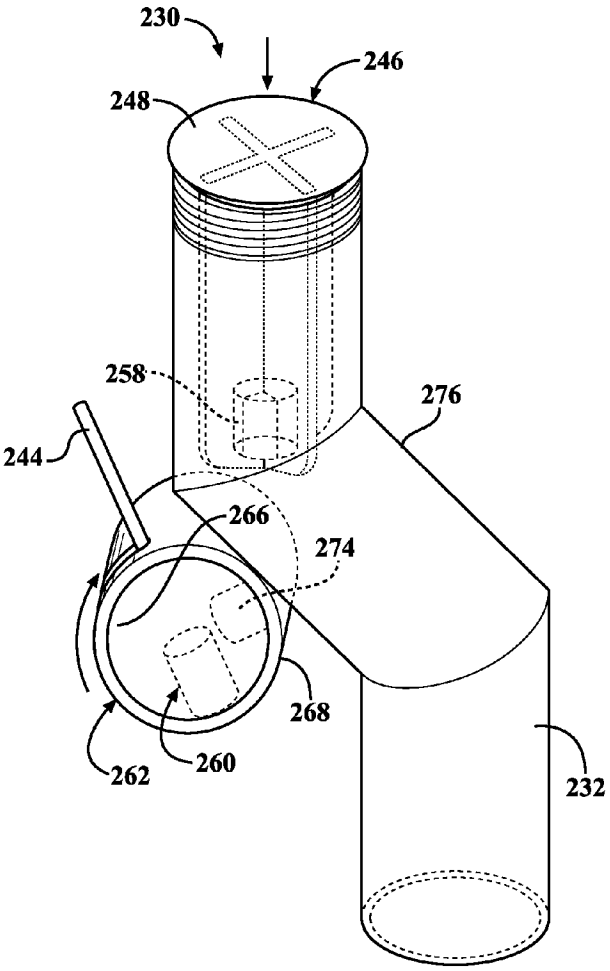
FIG. 14 is a view as in FIG. 13 but showing the stopper in a lowered condition.
Figure 13:
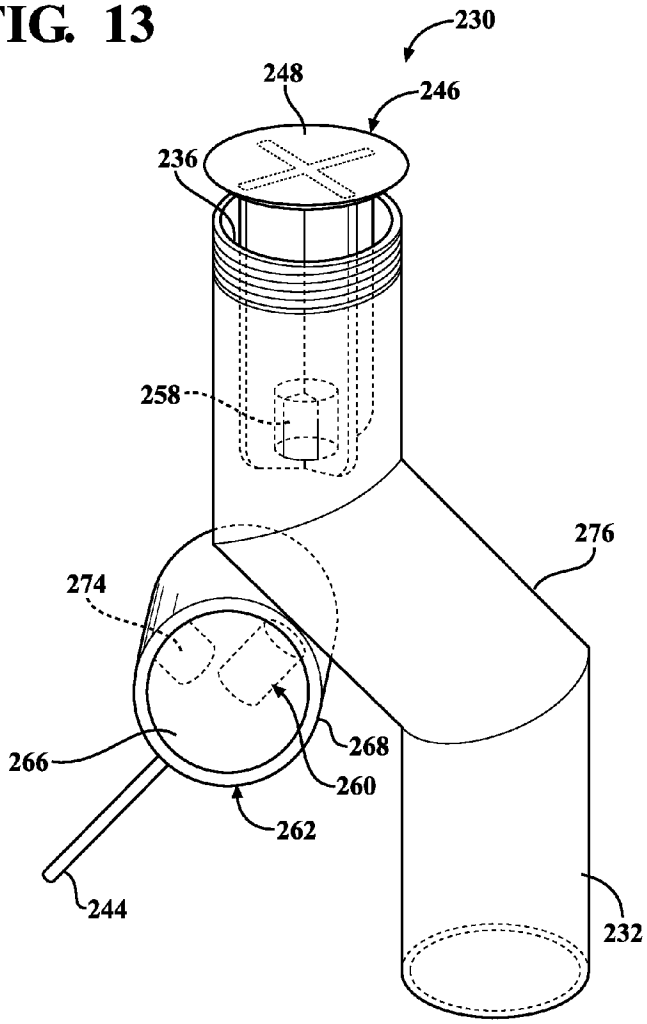
FIG. 13 is a perspective view of a magnetically actuated stopper and drain assembly according to a second embodiment of the invention with the stopper depicted in a lifted or raised condition to allow the drainage of fluids into the drain pipe.

Referring now to FIGS. 13 and 14, a second embodiment of the present invention is depicted. In this embodiment, wherein like reference numerals offset by 200 are used to indicate like or corresponding parts, the drain pipe 232 includes an offset section 276 immediately below the stopper magnet 258. In this embodiment, the curvilinear actuator 262 is located along the offset section 276 so that its base 266 is positioned underneath the stopper magnet 258. The flanking legs of the preceding embodiment are omitted here, with the driver magnet 260 comprising only a supplemental push-up magnet 272. This orientation of the curvilinear actuator 262 relative to the stopper magnet 258 requires the optional the draw down magnet 274 (if used) to be oriented so that its magnetic field flux operates to pull the stopper 46 downwardly through magnetic attraction. By locating the driver magnet 260 directly underneath the stopper magnet 258, a more efficient interaction of the magnetic flux can be achieved thereby improving the displacement force of the driver magnet 260 so that the legs can be omitted. Of course, if additional lifting force is needed or desired, flanking legs can be added to this embodiment of the curvilinear actuator 262 as well.

Figure 16:
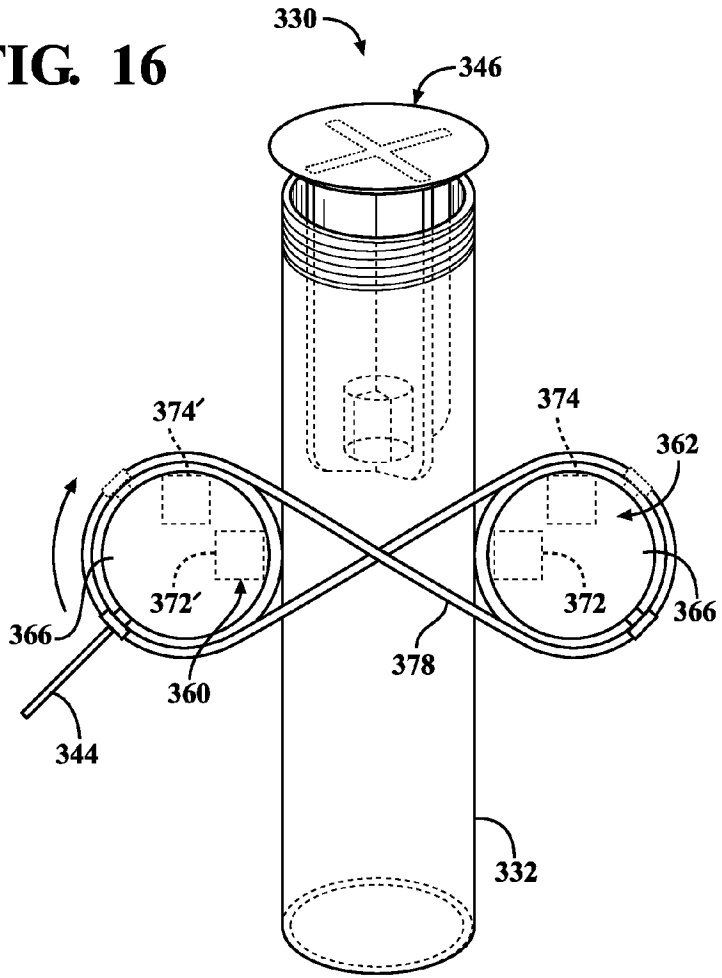
FIG. 16 is a side view of the third embodiment of the invention showing the stopper raised in solid lines and lowered in broken lines.
Figure 15:
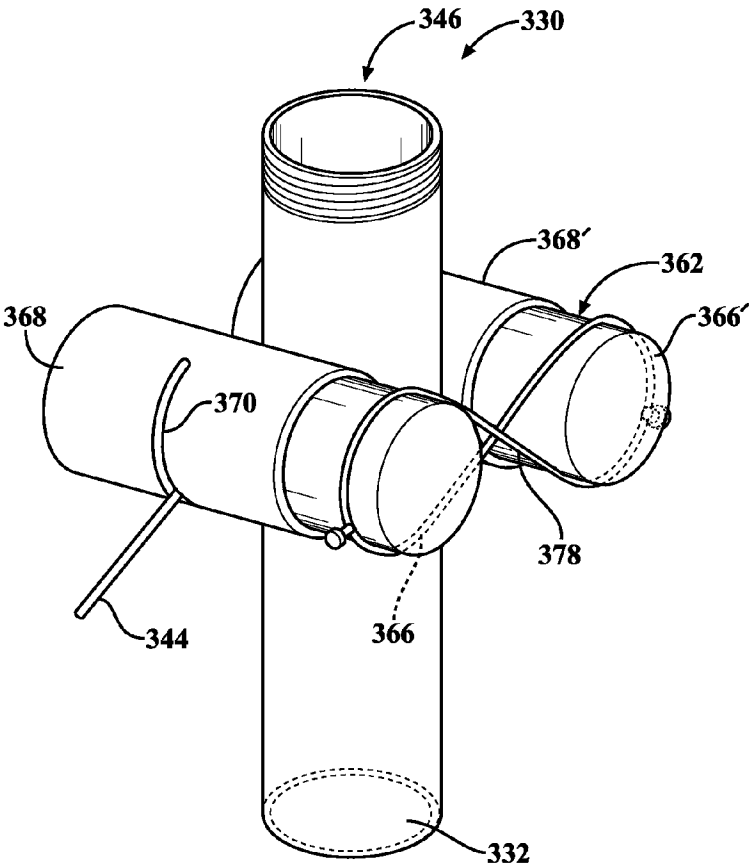
FIG. 15 is a perspective view of a magnetically actuated stopper and drain assembly according to a third embodiment of the invention.

FIGS. 15 and 16 illustrate a third embodiment of the present invention. In this embodiment, wherein like reference numerals offset by 300 are used to indicate like or corresponding parts, the drain pipe 332 takes the traditional straight form, but the curvilinear actuator 362 includes a pair of opposing bases 366, 366' supported in respective hinge brackets 368, 368'. The two opposing bases 366, 366' are mechanically connected for synchronized rotation via an interconnecting drive belt 378. A control rod 344 extends from only one of the bases 366 for connection to the push rod (not shown) as described above. Articulation of the one control rod 344 causes the opposing base 366' to rotating in an equal but opposite directions within its hinge bracket 368'. The driver magnet 360 in this embodiment includes only supplemental push-up magnets 372, 372' as in the immediately preceding embodiment, with flanking legs again being omitted here. It should be appreciated, however, that if additional lifting force is needed or desired, flanking legs can be added to this embodiment one or both of the bases 366, 366'. Depending on the placement and orientation of the optional draw down magnets 374, 374' (if used) the magnetic field flux interaction with the stopper magnet 358 may operate either through magnetic attraction or magnetic repulsion. Alternative mechanical mechanisms may be substituted for the interconnecting drive belt 378 in order to achieve synchronized mirror-like rotation of the two bases 366, 366'. For but one example, meshing gears can be used.

Figure 18:
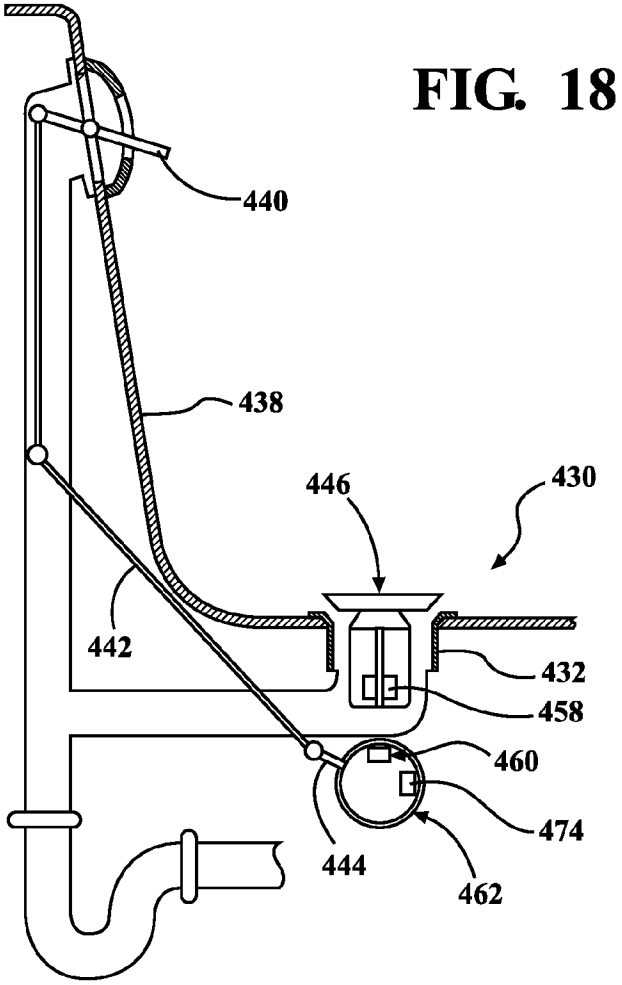
FIG. 18 is a view as in FIG. 17 with the stopper in a raised condition.
Figure 17:
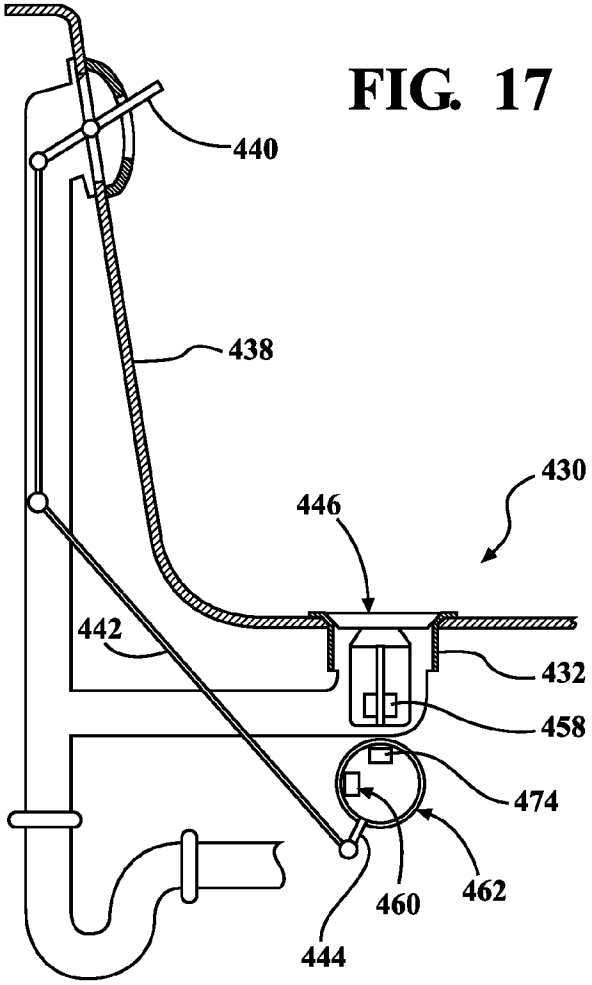
FIG. 17 is a simplified cross-sectional view through a bath tub drain assembly illustrating a fourth alternative embodiment of the invention with the stopper in a lowered condition.

A fourth embodiment of the present invention is shown in FIGS. 17 and 18 illustrating a bathtub application. In this embodiment, like reference numerals offset by 400 are used to indicate like or corresponding parts. Because the typical bathtub drain pipe 432 has a sharp bend shortly below its upper entrance 436, the curvilinear actuator 460 can be located directly below the stopper magnet 458. This embodiment also illustrates the dimensional and proportional adaptability of the present invention to suit different basin 438 types and applications.

Figure 19:
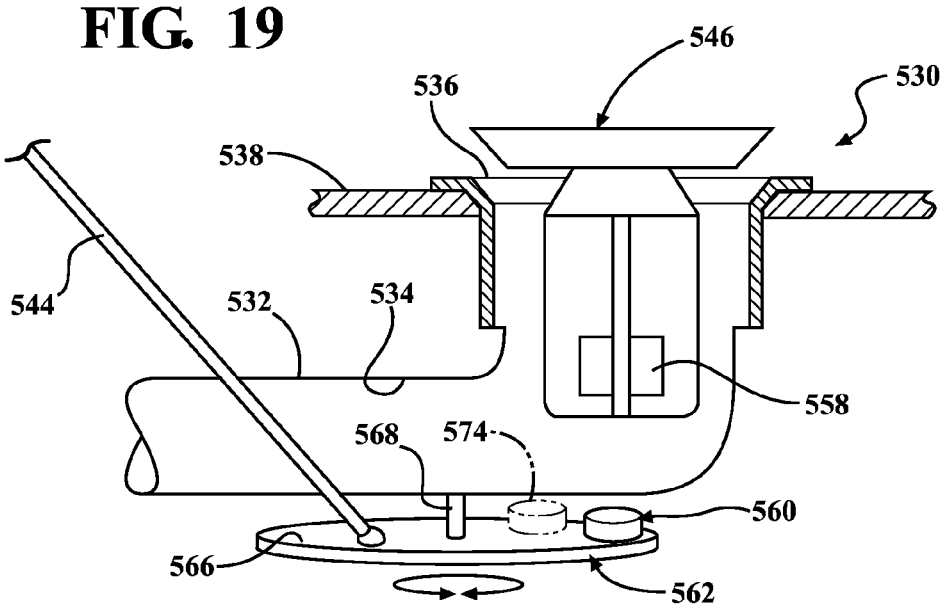
FIG. 19 is an enlarged, simplified view through a bath tub drain assembly illustrating a fifth alternative embodiment of the invention.

FIG. 19 illustrates a fifth embodiment of the invention wherein like reference numerals offset by 500 are used to indicate like or corresponding parts. As in the immediately preceding embodiment, the invention is shown in the exemplary application of a bathtub, it being understood however that other basin 538 types and applications may be applicable. Here in the curvilinear actuator 560 is supported for rotation in a generally horizontal plane. Manipulation of the push rod or other actuating lever feature (not shown) cases the control rod 544 to pivot the plate-like base 566 about a hinge bracket 568 which is shown here in the form of a simple axle. All of the principles and advantages of the invention as described in connection with the preceding embodiments are applicable here as well. Some applications of the invention may be more favorably disposed to a curvilinear actuator 560 constructed in this design as compared with the preceding variations. As shown in phantom lines, and optional draw-down magnet 574 may be used here with its magnetic field flux oriented to attract the stopper magnet 558.

Figure 20:
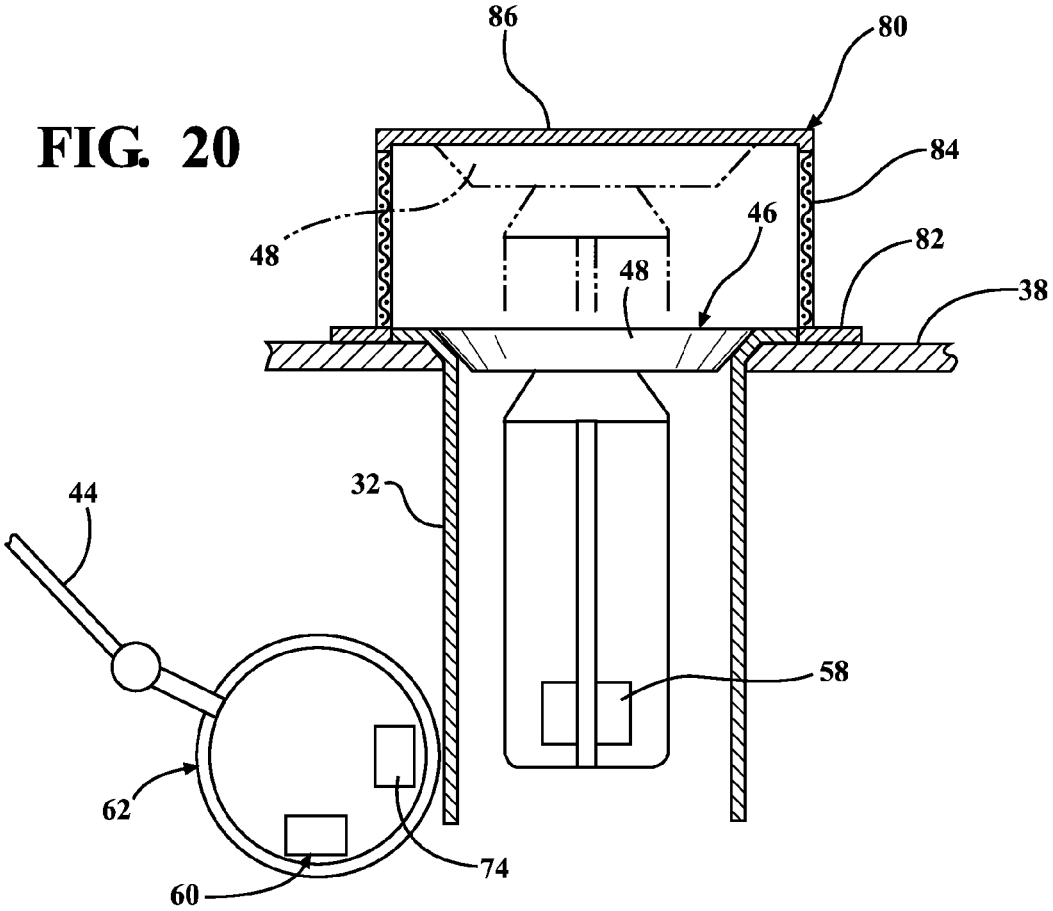
FIG. 20 is a simplified view of an optional drain cover for use in connection with a stopper of the present invention.

In FIG. 20, an optional feature of the present invention is depicted in the form of a magnetic drain cover, general indicated at 80. This drain cover 80 can be used in connection with any of the disclosed embodiments of the invention. The drain cover 80 includes flange 82 adapted for engagement with the basin 38 and/or the upper entrance 36 of the drain pipe 32. The flange 82 can simply rest in position, or be retained through a friction/force fit, or screw in place, or by other means be located in position shown. A screened or otherwise perforated side wall 84 extends upwardly from the flange 82. Water (or other liquid contained in the basin 38) can pass through the side wall 84 upon egress from the basin 38. The drain cover 80 includes a cap 86. In situations whether a relatively large quantity of liquid is drained rapidly from the basin 38, the drain cover helps route the exiting flow of liquid to the underside of the stopper head 48 so that the fluid flow does not end to pull the stopper 46 down toward the sealed condition. In other words, when the stopper 46 is lifted to the position shown in phantom in FIG. 20, the head 48 is placed in the lee formed by the cap 86 so that water pressure in the exiting flow tends to help keep the stopper 46 lifted. In this embodiment, the head 48 of the stopper 46 may further be magnetically attracted to the cover 86 with a light magnetic attraction force. When the stopper 46 is raised to the position shown in FIG. 20, the light magnetic attraction force further helps retain the stopper 46 in the lifted position. However, the attraction force will not be so strong as to thwart return of the stopper 46 to its sealed condition upon demand.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A drain stopper assembly for a drain pipe defining an internal drain passage and having an upper entrance leading into the drain passage, said assembly comprising:

a stopper disposed for movement with respect to the upper entrance toward and away from a sealed condition to prevent the passage of liquid into the drain passage, said stopper including a stopper magnet producing an electromagnetic field;

a driver magnet situated external to the drain pipe exterior, said driver magnet producing at least one electromagnetic field that generates a repellant electromagnetic field with respect to said stopper magnet, and said driver magnet swings in a compound trajectory comprised of lateral and longitudinal displacement toward said stopper magnet so that said electromagnetic fields interact in a non-linear relationship along a curved path of motion to induce movement of said stopper away from said sealed condition.

2. The drain stopper assembly of claim 1, wherein said driver magnet includes a pair of driver magnet halves configured for placement on opposite exterior sides of the drain pipe.

3. The drain stopper assembly of claim 2, wherein said pair of driver magnet halves are simultaneously rotatable toward said stopper magnet.

4. The drain stopper assembly of claim 3, further including a curvilinear actuator disposed external to the drain pipe and operatively supporting said driver magnet, wherein said curvilinear actuator has a generally U-shaped configuration defined by spaced apart legs connected though a common base.

5. The drain stopper assembly of claim 4, wherein said legs are moveable in concert to a position on opposite sides of the drain pipe.

6. The drain stopper assembly of claim 5, wherein one of said pair of driver magnet halves is disposed on one of said legs and the other of said pair of driver magnet halves is disposed on the other of said legs.

7. The drain stopper assembly of claim 1, further including a draw down magnet that generates a distinct electromagnetic field to induce movement of said stopper toward said sealed condition.

8. The drain stopper assembly of claim 7, further including a curvilinear actuator disposed external to the drain pipe and operatively supporting said driver magnet, wherein said curvilinear actuator has a generally U-shaped configuration defined by spaced apart legs connected though a common base, said draw down magnet disposed in said base.

9. The drain stopper assembly of claim 8, wherein said driver magnet includes a supplemental push-up magnet that generates a distinct repellant electromagnetic field emanating from said base to induce movement of said stopper away from said sealed condition.

10. The drain stopper assembly of claim 9, wherein said curvilinear actuator operatively supports said draw-down magnet and said supplement push-up magnet for concerted movement along said curved path.

11. The drain stopper assembly of claim 1, wherein said compound trajectory comprises a generally circular arc.

12. The drain stopper assembly of claim 1, further including a curvilinear actuator disposed external to the drain pipe and operatively supporting said driver magnet, and a hinge bracket operatively pivotally interconnecting said curvilinear actuator.

13. The drain stopper assembly of claim 12, wherein said hinge is disposed in a generally horizontal plane so that said curvilinear actuator swings in a generally vertical arc.

14. The drain stopper assembly of claim 1, wherein said stopper includes a head and a guide section depending from said head.

15. The drain stopper assembly of claim 14, wherein said guide section has a lower distal end spaced apart from said head, said stopper magnet disposed in said guide section adjacent said distal end thereof.

16. A drain stopper assembly, comprising:

a drain pipe defining an internal drain passage, said drain passage having an upper entrance leading into said drain passage, said drain pipe having an exterior;

a push rod disposed for manipulation in a generally up and down path by a user, said push rod including an interface member;

a stopper disposed for movement with respect to said upper entrance toward and away from a sealed condition, said stopper including a head, a guide section depending from said head, said guide section having a lower distal end spaced apart from said head, said stopper including a stopper magnet producing an electromagnetic field, said stopper magnet disposed in said guide section adjacent said distal end thereof;

a driver magnet situated external to said drain pipe exterior, said driver magnet producing at least one electromagnetic field that generates a repellant electromagnetic field with respect to said stopper magnet to induce movement of said stopper away from said sealed condition, said driver magnet including a pair of driver magnet halves disposed on opposite exterior sides of said drain pipe, and said pair of driver magnet halves swings in a compound trajectory comprised of lateral and longitudinal displacement toward said stopper magnet, so that said electromagnetic fields interact in a non-linear relationship along a curved path of motion to induce movement of said stopper away from said sealed condition, said compound trajectory comprising a generally circular arc, a hinge bracket fixed to said drain pipe; a hinge operatively pivotally interconnecting said hinge bracket, said pair of driver magnet halves simultaneously rotatable toward said stopper magnet along the generally circular arc of said compound trajectory.

17. The drain stopper assembly of claim 16, including a draw down magnet that generates a distinct electromagnetic field to induce movement of said stopper toward said sealed condition.

18. The drain stopper assembly of claim 16, wherein said driver magnet includes a supplemental push-up magnet.

19. A method of moving a drain stopper between a sealed and unsealed condition, comprising:

providing a drain pipe having an upper entrance;

positioning a stopper in the upper entrance, the stopper including a stopper magnet producing an electromagnetic field;

situating a driver magnet external to the drain pipe, the driver magnet producing at least one electromagnetic field;

swinging the driver magnet in a compound trajectory comprised of lateral and longitudinal displacement toward the stopper magnet to induce movement of the stopper away from the upper entrance as a result of interacting electromagnetic fields in a non-linear relationship between the stopper magnet and the driver magnet along a curved path of motion.

20. The method of claim 19, wherein said situating step includes locating a pair of driver magnet halves on opposite exterior sides of the drain pipe, and said moving step includes simultaneously rotating both driver magnet halves toward the stopper magnet.

* * * * *